United States Patent [19]

Anderson

[11] Patent Number: 4,933,821

[45] Date of Patent: Jun. 12, 1990

[54] REFLECTOR EDGE ILLUMINATOR FOR FLUORESCENT LIGHT

[75] Inventor: Roger M. Anderson, Minneapolis, Minn.

[73] Assignee: Minnesota Mining and Manufacturing Company, St. Paul, Minn.

[21] Appl. No.: 348,308

[22] Filed: May 5, 1989

[51] Int. Cl.[5] ..... F21S 3/02

[52] U.S. Cl. ..... 362/223; 362/307; 362/308; 362/311; 362/328; 362/343

[58] Field of Search ..... 362/223, 260, 339, 145, 362/148, 307, 308, 309, 311, 328, 343

[56] References Cited

U.S. PATENT DOCUMENTS

| | | | |
|---|---|---|---|
| 2,050,429 | 8/1936 | Dorey et al. | 240/11.4 |
| 2,175,067 | 10/1939 | Rolph | 240/106 |
| 3,085,152 | 4/1963 | Schwartz et al. | 240/51.11 |
| 3,125,301 | 3/1964 | Stotter | 240/51.11 |
| 3,278,743 | 10/1966 | Franck | 362/339 X |
| 4,075,775 | 2/1978 | Shorette | 40/553 |
| 4,078,169 | 3/1978 | Armstrong | 362/122 |
| 4,089,129 | 5/1978 | Patterson, Jr. | 40/606 |
| 4,118,763 | 10/1978 | Osteen | 363/339 |
| 4,218,726 | 8/1980 | Fukasawa et al. | 362/23 |
| 4,223,374 | 9/1980 | Kimmel | 362/31 |
| 4,229,913 | 10/1980 | Corrigan | 52/38 |
| 4,260,220 | 4/1981 | Whitehead | 350/96.28 |
| 4,338,653 | 7/1982 | Marrero | 362/260 X |
| 4,464,707 | 8/1984 | Forrest | 362/223 X |
| 4,517,758 | 5/1985 | Thompson | 40/431 |
| 4,536,830 | 8/1985 | Wisniewski | 362/223 |
| 4,593,345 | 6/1986 | Beggr | 362/339 X |
| 4,615,579 | 10/1986 | Whitehead | 350/96.1 |
| 4,642,737 | 2/1987 | Meyers, Jr. | 363/61 |

FOREIGN PATENT DOCUMENTS

| | | |
|---|---|---|
| 0151850 | 8/1985 | European Pat. Off. . |
| 477560 | 1/1938 | United Kingdom . |

*Primary Examiner*—Ira S. Lazarus
*Assistant Examiner*—Sue Haearman
*Attorney, Agent, or Firm*—Donald M. Sell; Walter N. Kirn; Stephen W. Bauer

[57] ABSTRACT

An illuminator adapted to be illuminated by a fluorescent lamp mounted in a light fixture when the fluorescent lamp is emitting light to indicate that the fluorescent light is turned on. The light fixture is of the type having a fixture casing for holding the fluorescent lamp and including a specular reflector for reflecting the light emitted from the lamp generally downwardly toward an area to be illuminated without the light passing through a light diffuser. The illuminator comprises a generally transparent or translucent illuminator body, and illuminator-mounting flanges adapted for mounting the illuminator body on the fixture casing or reflector without the body interfering with or intersecting light transmitted generally directly downwardly toward the area to be illuminated. The body includes material having such an index of refraction and surfaces so contoured that a portion of the light originating from the fluorescent lamp is refracted at a sharp angle (e.g., greater than 55–65 degrees) with respect to the light reflected generally downwardly by the reflector to indicate to viewers along the sharp angle that the light is turned on.

18 Claims, 1 Drawing Sheet

Fig. 1
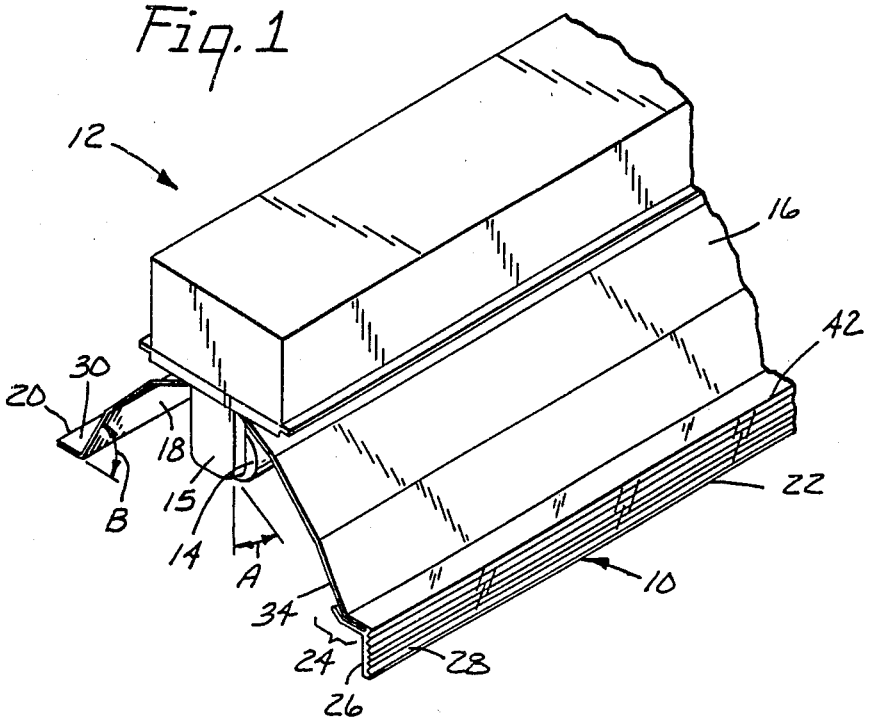
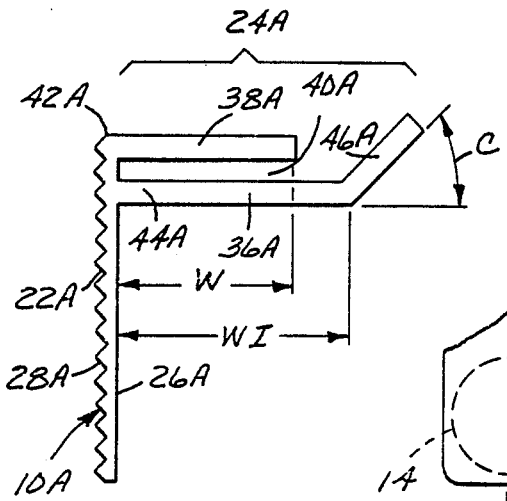
Fig. 3
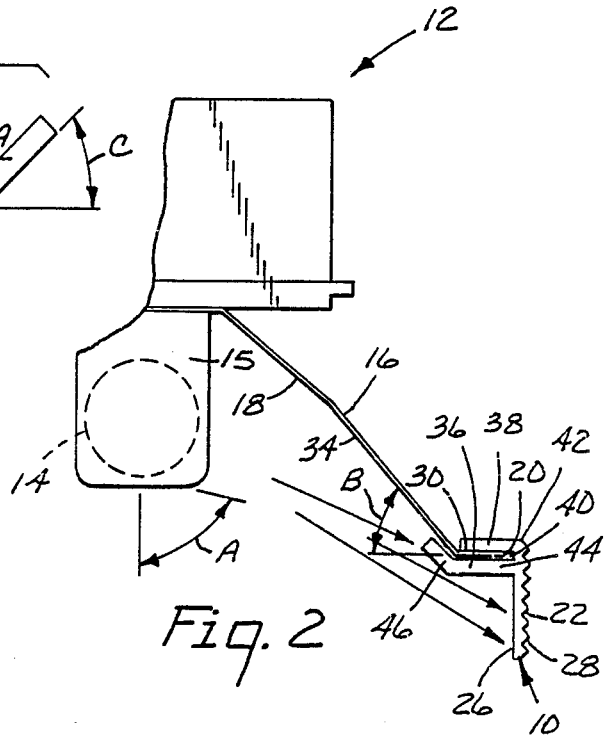
Fig. 2

REFLECTOR EDGE ILLUMINATOR FOR FLUORESCENT LIGHT

This invention relates to an illuminator adapted to illuminate along the edge of a specular or energy efficient reflector used with a flourescent lamp to indicate whether the lamp is turned on.

BACKGROUND OF THE INVENTION

Fluorescent light fixtures have traditionally employed translucent light diffusers that refract light in every or almost every direction, including toward the ceiling and walls of a room being illuminated, in addition to the floor or work area intended to be illuminated. One such light fixture is described in U.S. Pat. No. 3,085,152. While such fixtures have successfully been used for years to provide light in a desired area, substantial amounts of light and energy are wasted by the fixture due to light being directed toward areas, such as ceilings, where the light is not needed or desired. However, one heretofore unnoticed benefit of dispersing light over a large area is that people, e.g., customers, outside of the area being illuminated could readily ascertain whether the light is turned on by observing light reflected from the walls or ceiling of the illuminated room through windows.

In response to various energy shortages, light fixtures are now being provided without such light diffusers and with specular (e.g., polished) or energy efficient reflectors that reflect light directly toward the area in which illumination is desired. In addition, many traditional style light fixtures are being upgraded by removing the light diffuser and adding a specular reflector. One unforeseen drawback with such fixtures is that viewers outside the area being illuminated cannot readily ascertain whether the lights are turned on. Because the light is not reflected onto adjacent areas and the light reflector and/or fixture casing obstruct light directly emitted from the fluorescent lamp at a sharp angle (e.g., greater than 55–60 degrees) with respect the downwardly reflected light, viewers along or above such a "sharp" angle are unable to determine whether the light is turned on, and as a result they are likely to believe the light is turned off even when it is turned on. This problem is particularly acute in convenience stores that remain open throughout the night. Business is lost when potential customers, believing the store is closed, drive past the store without entering However, such "all-night" operations benefit the most from energy efficient lighting since their lights are always on.

SUMMARY OF THE INVENTION

The invention provides an illuminator that is adapted to be illuminated when a fluorescent lamp is emitting light to indicate that the lamp is turned on; that is designed to illuminate along the edge or edges of a light fixture having a specular or energy efficient reflector for reflecting the light emitted from the lamp generally downwardly toward an area to be illuminated without the light passing through a light diffuser; that is designed not to interfere with light reflected generally downwardly toward the area to be illuminated; that refracts light at a sharp angle (e.g., greater than 55–65 degrees) with respect to the light directed toward the area to be illuminated so that viewers outside of the illuminated area may readily determine whether the light is turned on; that is inexpensive to manufacture and easy to install; and that is simple in construction and reliable in use.

Generally, the illuminator of this invention comprises a generally transparent or translucent illuminator body, and illuminator-mounting means adapted for mounting the illuminator body on a fixture casing without the body interferring with or intersecting light transmitted generally directly downwardly toward the area to be illuminated. The body includes material having such an index of refraction and surfaces so contoured that a portion of the light originating from the fluorescent bulb is refracted at a sharp angle with respect to the light reflected generally downwardly by the reflector to indicate to viewers along the sharp angle that the light is turned on.

In a second aspect of the invention, the illuminator is provided in combination with a light fixture comprising a fixture casing, lamp-holding means mounted on the fixture casing for releasably holding a fluorescent lamp, and a reflector associated with the fixture casing for reflecting the light generally downwardly toward an area to be illuminated without the light passing through a light diffuser.

Other features will be in part apparent and in part pointed out hereinafter.

BRIEF DESCRIPTION OF THE DRAWING

The invention will be further described with reference to the drawing wherein corresponding reference characters indicate corresponding parts throughout the several views of the drawing, and wherein:

FIG. 1 is a perspective view of a light fixture on which an illuminator of the present invention is mounted;

FIG. 2 is an enlarged end view of the light fixture and illuminator of FIG. 1; and FIG. 3 is a further enlarged end view of a second embodiment of the illuminator of the invention.

Reference numerals ending with the letter "A" in FIG. 3 refer to features similar to those designated with the same reference numerals in FIGS. 1 and 2 that do not end with the letter "A".

DETAILED DESCRIPTION

Referring now to the drawing, an illuminator of this invention is designated in its entirety by the reference numeral 10 or 10A, and is adapted to be used with an elongate fluorescent light fixture 12 of the type that does not include a light diffuser, such as the diffuser shown in U.S. Pat. No. 3,085,152. The light fixture 12 includes lamp-mounting means (e.g., bracket 15) for holding an elongate fluorescent lamp or bulb 14. Light emitted from the fluorescent lamp 14 is reflected substantially directly downwardly by a reflector 16 toward the area intended to be illuminated without being dispersed by a diffuser toward adjacent areas, such as the walls or ceiling adjacent the illuminated area. Light emitted from the lamp 14 would ordinarily not be visable at a "sharp" angle A (e.g., greater than approximately 55–65 degrees) with respect to the downwardly reflected light without the illuminator 10, 10A due to the fixture casing 16 and/or reflector 18 blocking light above this angle A. The illuminator 10, 10A is designed to illuminate along the edge 20 of the fluorescent light fixture 12 when a fluorescent lamp 14 is emitting light to indicate to viewers at or above the sharp angle A and outside of the area normally being illuminated by the light that the fluorescent lamp 14 is turned on.

As shown in FIGS. 1–3, the illuminator 10, 10A comprises a generally transparent or translucent illuminator body 22, 22A, and illuminator-mounting means 24, 24A adapted for mounting the illuminator body 22, 22A on the fixture casing 16 or reflector 18 without the body 22, 22A interferring with or intersecting light transmitted generally directly downwardly toward the area to be illuminated. The illuminator-mounting means 24, 24A is formed on the illuminator body 22, 22A such that the inside surface 26, 26A is adapted to generally face the fluorescent lamp 14 and light originating from the lamp 14 passes first through the inside surface 26, 26A and then through the outside surface 28, 28A of the illuminator body 22, 22A. The body 22, 22A of the illuminator includes material having such an index of refraction and inside and outside surfaces 26, 26A and 28, 28A so contoured that a portion of the light originating from the fluorescent lamp 14 is refracted at the sharp angle A with respect to the light reflected generally downwardly by the reflector 18 to indicate to viewers along the sharp angle A that the light is turned on. Suitable materials for the body 22, 22A include transparent acrylic resin material having a refractive index of approximately 1.49, such as sold under the trade designation "Plexiglas V811" by the Rohm and Haas Company of Philadelphia, Pa., and polycarbonate material having a refractive index of approximately 1.58, although other transparent or translucent materials may also be suitable.

As shown in FIG. 2, the fixture casing 16 (and reflector 18) may be elongate and of the type having elongate rims 30 generally along the opposite edges 20 of the casing 16. The rims 30 extend generally horizontally or laterally outwardly at an angle B (e.g., approximately 45 degrees) from an inner portion 34 of the fixture casing 16 along the length of the casing 16. Alternatively, the fixture casing may be of any suitable conventional design, and a specular or energy efficient reflector (not shown) may be provided as a "retrofit" to improve the energy efficiency of the light fixture. Such a "retrofit" reflector may include rims that are substantially identical to the rims 30 discussed above. When a rim 30 of the fixture casing 16 is referred to hereinafter, the discussion is intended to also apply to a rim of such a "retrofit" reflector.

The illuminator-mounting means 24, 24A preferably comprises two generally parallel elongate mounting flanges 36, 36A and 38, 38A extending from the inside surface 26, 26A of the body 22, 22A along substantially the entire length of the body 22, 22A. The mounting flanges 36, 36A and 38, 38A define a channel 40, 40A between the flanges for receiving a rim 30 of the fixture casing 16 to mount the illuminator 10, 10A on the fixture casing 16. As shown in FIG. 2, the outer or upper mounting flange 38 extends generally horizontally and perpendicularly inwardly (leftwardly in FIG. 2) from the inside surface of the body 22 along the upper edge 42 of the body 22. An inner part 44 of the inner or lower mounting flange 36 extends horizontally inwardly from the inside surface 26 of the body 22 along a plane parallel to the upper mounting flange 38, and is spaced from the upper flange 38 a distance sufficient for receiving the rim 30 between the flanges 36 and 38, such as a distance equal to the thickness of the flanges 36, 38 (e.g., approximately 1/16 in. (1.6mm)). The inner part 44 is adapted for engaging the downwardly facing surface of the rim 30, and the outside mounting flange 38 is adapted for engaging the upwardly facing surface of the rim 30. For example, the inner part 44, 44A of the lower mounting flange 36, 36A may have a width WI (e.g., approximately ⅝ in. (16mm)) as illustrated in FIG. 3 slightly longer than the total width W of outer or upper mounting flange 38, 38A (e.g., approximately ½ in. (13mm)), the width W of the upper flange 38, 38A being shorter to accommodate the angle B of the fixture casing 16.

As illustrated in FIG. 3, an outer part 46, 46A of the inner mounting flange 36 extends from the inner part 44, 44A at an angle C (e.g., approximately 45 degrees) generally corresponding to the angle B of the rim 30. The outer part 46, 46A may have a width substantially less than the width WI or W of either of the inner part 44, 44A or the outside mounting flange 38, 38A (e.g., approximately ¼ in. (6mm)). The outer part 46, 46A is adapted to engage a portion of the inner portion 34 of the fixture casing 16 to retain the illuminator 10 thereon, and is preferably positioned generally adjacent or along a portion of the reflecting surface 18 of the fixture casing 16.

The inner and outer parts 44, 44A and 46, 46A of the inner mounting flange 36, 44A are prefereably formed of generally transparent or translucent material, such as the material of the illuminator body 22, 22A, and both the inner and outer flanges 36, 36A and 38, 38A are most preferably integrally molded or extruded with the body 22, 22A of the same material. As used herein, the words "integral", "integrally" and "one-piece construction" refer to one continuous or integral structure, and not to a structure formed by mechanically fastening or welding various elements together. Since the inner mounting flange 36, 36A is transparent or translucent and positioned adjacent the reflecting surface 18, light originating from the fluorescent lamp 14 illuminates the inner mounting flange 36, 36A and is directed through the inner flange into the body 22, 22A of the illuminator to illuminate at least a portion of the body 22, 22A. As illustrated in FIG. 2, light originating from the fluorescent lamp 14 also directly illuminates a portion of the body 22.

Preferably, the outside surface 28, 28A of the illuminator body 22, 22A has a generally saw-tooth configuration (FIGS. 2 and 3) forming a plurality of prisms. These prisms refract light illuminating the body 22, 22A generally along the sharp angle A with respect to the light reflected downwardly by the reflector or reflecting surface 18 (e.g., by refracting and diffusing light at angles of 45–120 with respect to the downwardly reflected light). As shown in FIG. 3, the saw-tooth surfaces may be formed at an angle of approximately 45 degrees from the plane of the body 22A to form a plurality (e.g., 14) of V-shaped channels longitudinally along the outer surface 28A of the body 22A, and a plurality of peaks (e.g., 15) separating adjacent V-shaped channels. The V-shaped channels, for example, may have a depth of approximately 1/32 in. (0.8mm) in a body 22A having a total thickness of approximately 1/16 in. (1.6mm) and height of approximately one inch (25mm). This particular configuration is illustrated in FIG. 3, and is believed to form a distinctive appearance when illuminated, with bright horizontal bands of light formed adjacent the upper and lower edges of the body 22A separated by a dark horizontal band in the middle.

The body configuration illustrated in FIG. 2 is similar in some respects to that of FIG. 3, with exceptions including a thicker body 22 (e.g., ⅛ in. (3mm) or more) and fewer peaks (e.g., 8) separating fewer channels (e.g., 7). The illuminator body 22 of FIG. 2 is designed to be illuminated without a dark middle band. Alternatively, the thickness of the lower mounting flange 36, 36A may be increased to amplify the illumination of the body 22, 22A.

Illuminator bodies having configurations other than those illustrated in FIGS. 2 and 3 may also be employed in carrying out the invention. For example, the illuminator body may have a generally saw-tooth configured inside or outside surface forming a fresnel lens for diffusing light generally along the sharp angle with respect to the light reflected generally downwardly by the fixture casing.

As various changes could be made in the above constructions without departing from the scope of the invention, it is intended that all matter contained in the above description or shown in the accompanying drawing shall be interpreted as illustrative and not in a limiting sense.

What is claimed:

1. An illuminator adapted to be illuminated by a fluorescent lamp mounted in a light fixture when the fluorescent lamp is emitting light to indicate that the fluorescent light is turned on, the light fixture being of the type having a fixture casing for holding the fluorescent lamp and including a specular reflector for reflecting the light emitted from the lamp generally downwardly toward an area to be illuminated without the light passing through a light diffuser, with the fluorescent lamp being hidden by the fixture from a viewer outside the area to be illuminated; the illuminator comprising a generally transparent or translucent illuminator body having a width, and illuminator-mounting means adapted for mounting the illuminator body on the fixture casing with the width of the body extending generally downwardly from the fixture casing without the body interfering with or intersecting light transmitted generally directly downwardly toward the area to be illuminated and with only a small portion of light transmitted from the fluorescent lamp intersecting the body, the body including material having such an index of refraction and surfaces so contoured that only the small portion of the light is refracted generally at a sharp angle with respect to the light reflected generally downwardly by the reflector to indicate to viewers outside the area being illuminated that the light is turned on.

2. An edge illuminator according to claim 1 adapted for use with a fixture casing or reflector of the type having a rim generally along the edges of the casing; the illuminator-mounting means comprising two generally parallel mounting flanges extending from the body defining a channel for receiving the rim of the fixture casing or reflector to mount the illuminator on the fixture casing or reflector.

3. An edge illuminator according to claim 2 adapted for use with the rim of a fixture casing or reflector of the type wherein the rim extends generally at an angle from an inner portion of the fixture casing or reflector; the mounting flanges including at least one mounting flange having an inner part adapted for engaging the rim of the fixture casing or reflector, and an outer part extending from the inner part at an angle generally corresponding to angle of the rim such that the outer part is adapted to engage a portion of the inner portion of the fixture casing or reflector to retain the illuminator thereon.

4. An edge illuminator according to claim 2 adapted for use with an elongated fluorescent light fixture having an elongate fixture casing for holding an elongate fluorescent lamp, and the fixture casing or reflector having a rim extending generally latetally outwardly from the inner portion of the fixture casing or reflector along the length of the casing or reflector the illuminator body being generally elongate and having a length, the mounting flanges extending generally laterally from the body along the length of the body.

5. An edge illuminator according to claim 4 adapted for use with a fixture casing or reflector of the type having a rim extending generally at an angle from an inner portion of the fixture casing or reflector; the mounting flanges including at least one mounting flange having an inner part and an outer part extending from the inner part at an angle generally corresponding to the angle of the rim such that the outer part is adapted to engage a portion of the inner portion of the fixture casing or reflector to retain the illuminator thereon.

6. An edge illuminator according to claim 4 wherein the mounting flanges include an inner mounting flange adapted to be positioned generally adjacent a reflecting surface of the reflector, the inner mounting flange being formed of generally transparent or translucent material such that light originating from the fluorescent lamp illuminates the inner mounting portion and is directed into the body of the illuminator to illuminate at least a portion of the body.

7. An edge illuminator according to claim 1 wherein the body has a surface with a generally saw-tooth configuration forming a plurality of prisms for refracting light illuminating the body generally along the sharp angle with respect to the light reflected downwardly by the reflector.

8. An edge illuminator according to claim 7 wherein the generally saw-tooth configured surface of the body forms a fresnel lens for diffusing light generally along the sharp angle with respect to the light reflected generally downwardly by the fixture casing.

9. An edge illuminator according to claim 7 wherein the generally saw-tooth configured surface constitutes an outside surface of the illuminator body, the body having an inside surface, the illuminator-mounting means being formed on the illuminator body such that the inside surface is adapted to generally face the fluorescent lamp and light originating from the lamp passes first through the inside surface and then through the outside surface of the illuminator body.

10. A combination of a fluorescent light fixture and an edge illuminator for illuminating the edge of the light fixture when the fluorescent light is emitting light to indicate that the fluorescent light is turned on; the light fixture comprising a fixture casing, lamp-holding means mounted on the fixture casing for releasably holding a fluorescent lamp, and a reflector associated with the fixture casing for reflecting the light generally downwardly toward an area to be illuminated without the light passing through a light diffuser, the lamp-holding means and reflector being arranged relative to one another such that the fluorescent lamp is hidden from a viewer outside the area to be illuminated; the illuminator comprising a generally transparent or translucent body having a width, and illuminator-mounting means for mounting the body on the fixture casing with the width of the body extending generally downwardly from the fixture casing without the body interfering with or intersecting light transmitted generally directly downwardly from the fluorescent lamp or reflector toward the area to be illuminated and with only a small portion of light transmitted from the fluorescent lamp intersecting the body, the body including material having such an index of refraction and surfaces so contoured that only the small portion of the light is substantially refracted at a sharp angle with respect to the light reflected generally downwardly by the reflector to indicate to viewers outside the area being illuminated that the light is turned on.

11. A combination according to claim 10 wherein the fixture casing has a rim generally along the edges of the casing; the illuminator-mounting means comprising two generally parallel mounting flanges extending from the body defining a channel for receiving the rim of the fixture casing to mount the illuminator on the fixture casing.

12. A combination according to claim 11 wherein the rim of a fixture casing extends generally at an angle from an inner portion of the fixture casing; the mounting flanges including at least one mounting flange having an inner part for engaging the rim of the fixture casing, and an outer part extending from the inner part at an angle generally corresponding to the angle of the rim such that the outer part engages a portion of the inner reflecting portion of the fixture casing to retain the illuminator thereon.

13. A combination according to claim 11 wherein the fluorescent light fixture and the mixture casing are generally elongate and adapted for holding an elongate fluorescent lamp, the rim of the fixture casing extending generally laterally outwardly from the inner portion of the fixture casing along the length of the casing; the illuminator body being generally elongate and having a length, the mounting flanges extending generally laterally from the body along the length of the body.

14. A combination according to claim 13 wherein the rim of the fixture casing extends generally at an angle from an inner portion of the fixture casing; the mounting flanges including at least one mounting flange having an inner part and an outer part extending from the inner part at an angle generally corresponding to angle of the rim such that the outer part engages a portion of the inner reflecting portion of the fixture casing to retain the illuminator thereon.

15. A combination according to claim 13 wherein the mounting flanges include an inner mounting flange adapted to be positioned generally adjacent a reflecting surface of the reflector, the inner mounting flange being formed of generally transparent or translucent material such that light originating from the fluorescent lamp illuminates the inner mounting portion and is directed into the body of the illuminator to illuminate at least a portion of the body.

16. A combination according to claim 10 wherein the illuminator body has a surface with a generally saw-tooth configuration forming a plurality of prisms for refracting light originating from the fluorescent lamp generally along the sharp angle with respect to the light reflected generally downwardly by the reflector to indicate to viewers along the sharp angle that the light is turned on.

17. A combination according to claim 16 wherein the generally saw-tooth configured surface of the illuminator body forms a fresnel lens for diffusing light generally along the sharp angle with respect to the light reflected generally downwardly by the reflector.

18. A combination according to claim 16 wherein the generally saw-tooth configured surface constitutes an outside surface of the illuminator body, the body having an inside surface, the illuminator-mounting means being formed on the illuminator body such that the inside surface generally faces the fluorescent lamp and light originating from the lamp passes first through the inside surface and then through the outside surface of the illuminator body.

* * * * *

UNITED STATES PATENT AND TRADEMARK OFFICE

CERTIFICATE OF CORRECTION

PATENT NO. : 4,933,821

DATED : June 12, 1990

INVENTOR(S) : Roger M. Anderson

It is certified that error appears in the above-identified patent and that said Letters Patent is hereby corrected as shown below:

Col. 6, line 3, "latetally" should read --laterally--.

Col. 6, line 5, after "reflector" insert --;--.

Col. 7, line 27, "mixture" should read --fixture--.

Signed and Sealed this

Sixth Day of August, 1991

*Attest:*

*Attesting Officer*

HARRY F. MANBECK, JR.

*Commissioner of Patents and Trademarks*